United States Patent [19]

Borsoi

[11] Patent Number: 4,575,955

[45] Date of Patent: Mar. 18, 1986

[54] SHOE, IN PARTICULAR A SKI SHOE, INCORPORATING A FLEX AND SIDE AND FORWARD LEAN ADJUSTMENT DEVICE

[75] Inventor: Bruno Borsoi, Conegliano Veneto, Italy

[73] Assignee: NORDICA S.p.A., Montebelluna, Italy

[21] Appl. No.: 396,548

[22] Filed: Jul. 9, 1982

[30] Foreign Application Priority Data

Jul. 23, 1981 [IT] Italy ..... 23099 A/73

[51] Int. Cl.[4] ..... A43B 5/04; A43B 11/00

[52] U.S. Cl. ..... 36/117; 36/50; 36/121

[58] Field of Search ..... 36/117–121, 36/50, 54; 24/274 R, 171, 194, 656

[56] References Cited

U.S. PATENT DOCUMENTS

| | | | |
|---|---|---|---|
| 3,570,148 | 3/1971 | Morgan | 36/121 |
| 3,609,887 | 10/1971 | Hickmann et al. | 36/121 |
| 4,258,482 | 3/1981 | Salomon | 36/121 |

FOREIGN PATENT DOCUMENTS

| | | | |
|---|---|---|---|
| 263577 | 7/1968 | Austria | 36/50 |
| 2043679 | 3/1972 | Fed. Rep. of Germany | 36/50 |
| 2057094 | 5/1973 | Fed. Rep. of Germany | 36/121 |
| 2371896 | 6/1978 | France | 36/120 |

*Primary Examiner*—James Kee Chi

*Attorney, Agent, or Firm*—Guido Modiano; Albert Josif

[57] ABSTRACT

The shoe has a front gaiter which comprises a first portion, mainly spanning the side regions of the skier's leg and being hinged to the shell, and a second portion, which mainly spans the front region of the skier's leg, and at least partly overlaps the first portion.

A strap is also provided of positioning and mutually securing the first portion and second portion together.

2 Claims, 16 Drawing Figures

SHOE, IN PARTICULAR A SKI SHOE, INCORPORATING A FLEX AND SIDE AND FORWARD LEAN ADJUSTMENT DEVICE

BACKGROUND OF THE INVENTION

This invention relates to a shoe, in particular a ski shoe, incorporating a flex and side and forward lean adjustment device.

As is known, ski shoes, with the advent of plastic material molding technology, increasingly tend to grow in height, and especially so the cuff or leg portion thereof, for the purpose of improving the shoe performance and user's comfort.

However, the advantages afforded by this ski boot concept have limitations, mainly on account of the difficult adaptation of the footwear to fit the varying configurations of individual skiers' limbs.

In fact, with conventional techniques, it is increasingly more important that the boot leg portion be perfectly shaped to fit the skier's leg lower part, and this has only been achieved by arranging for a very broad range of different sizes which, as may be appreciated, involves hardly solvable production problems.

Another currently felt problem is that connected with the possibility of adapting the footwear to the different skiing habits of each individual user, so that a product may be provided which best suit the varying skill and preferences of skiers.

SUMMARY OF THE INVENTION

Accordingly the task of this invention is to overcome such limitations by providing a ski shoe which affords the possibility of adjusting its flex and side and forward lean, thus enabling the individual skier to trim the footwear at will to meet his/her personal requirements.

Within this task it is an object of the invention to provide a ski shoe which, while having considerably improved features, has no complex structure and, above all, poses no production problems.

A further object of this invention is to provide a ski shoe which is extremely versatile and practical in use.

Yet another object of the invention is to provide a ski shoe which can be readily formed from elements and materials generally available on the market, while being highly competitive from the economical standpoint.

The above task and objects as well as yet other objects, such as will be apparent hereinafter, are achieved by a shoe, in particular a ski shoe, incorporating a flex and side and forward lean adjustement device, characterized in that it comprises a front gaiter having a first portion mainly spanning the side regions of a skier's leg and being hinged to the shell, and a second portion mainly spanning the front region of a skier's leg, said second portion at least partly overlapping said first portion, and in that means are provided for positioning and mutually securing said first and second portions together.

BRIEF DESCRIPTION OF THE DRAWINGS

Further features and advantages will be apparent from the following detailed description of some preferred, but not limitative, embodiments of this ski shoe with fex and lean adjustment features, with reference to the accompanying illustrative drawings, where.

DESCRIPTION OF THE PREFERRED EMBODIMENTS

Figure 1:
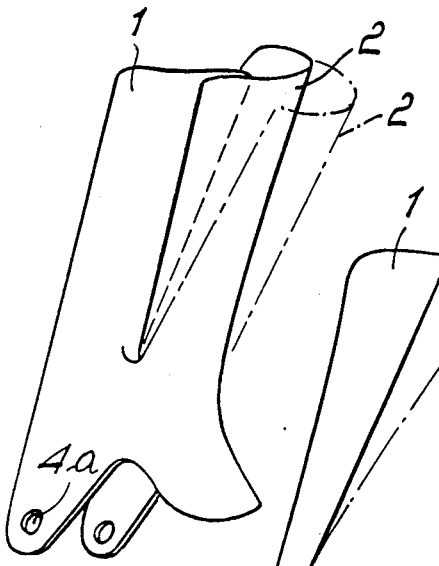
FIG. 1 shows a two-part front gaiter.
Figure 2:
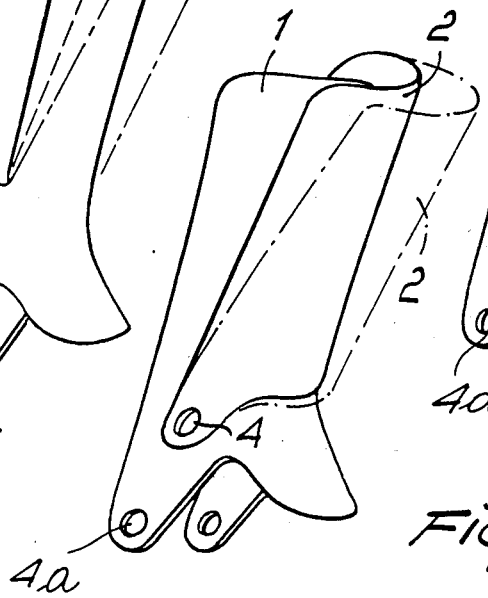
FIG. 2 shows a front gaiter having the second portion hinged on one side of the first portion.
Figure 3:
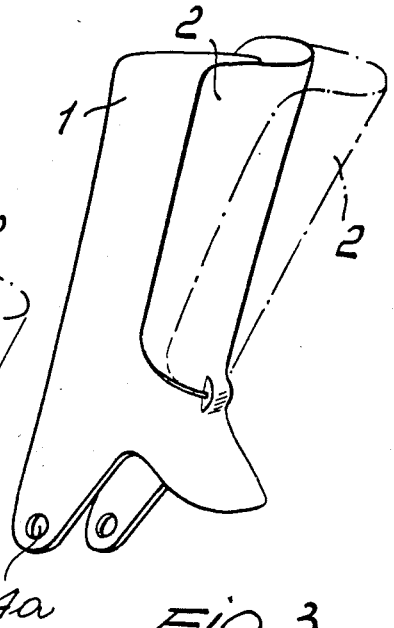
FIG. 3 shows a gaiter with the second portion hinged on the front of the first portion.

Making reference to the drawing figures, and in particular to FIGS. 1 to 3, it may be seen that a peculiar feature of the ski shoe according to the invention is that of providing an orientable front gaiter, which is implemented by dividing the gaiter itself into a first portion 1, which mainly spans the side regions of a skier's leg and is hinge connected in 4*a* to the shell. The gaiter also comprises a second portion 2 which mainly spans the front region of a skier's leg, and can be variously positioned with respect to the first portion 1.

More specifically, the two-part construction of the front gaiter may be implemented, as shown in FIG. 1, by making the first and second portions integral such that the second portion can at least in part overlap the first portion 1.

In the FIG. 2 the upwards extension whereof is shorter than the upwards extension of the rearwardly open first gaiter portion 1 and overlaps the front side thereof, the second portion 2 is hinged laterally, at the point 4, to the first portion such that it can be pivoted independently with respect to the first portion.

As visible in FIG. 2 the axis of hinge point 4 extends in widthwise direction and is offset with respect to the axis of hinge point 4*a*, which also extends in the widthwise direction of the gaiter.

A similar approach is shown in FIG. 3, wherein the hinge connection of the first and second portions is arranged on the front.

All the three embodiments just described permit the mutual positions of the first and second portions to be changed, thus varying the gaiter fit, since its lean and flex are varied accordingly. The possibility of changing its inclination both in a sideways and forward directions, also solves the problem of varus or valgus legs, without prejudice for a perfect fit to the leg conformation.

For mutually securing the first and second portions together, mutual securing and positioning means is provided between the first portion 1 and second portion 2 which may be variously configured.

The drawing figures illustrate but a few of the possible solutions, which should obviously be regarded as preferred embodiments, but not limitative ones.

Figure 4:
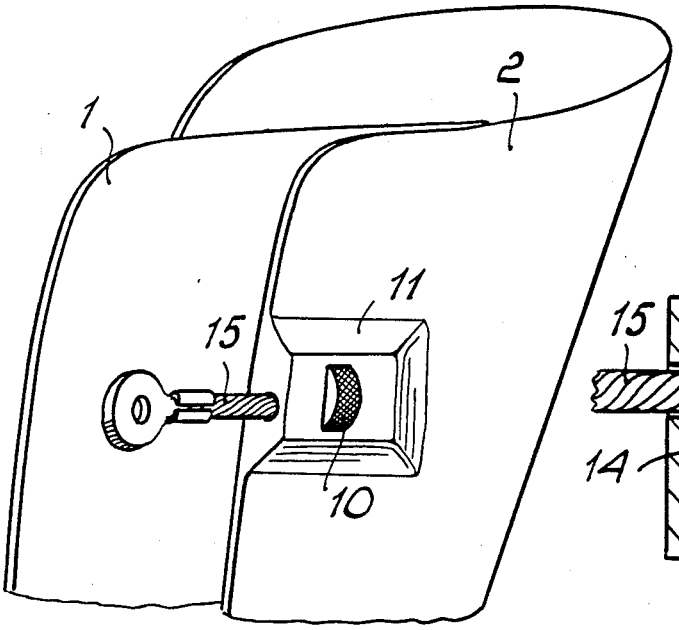
FIG. 4 shows schematically the securing means as actuatable by means of a knurled wheel.
Figure 5:
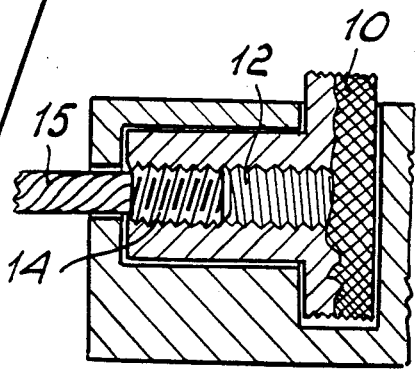
FIG. 5 is a partly cutaway view of the knurled wheel of the securing means shown in FIG. 4.

With expressed reference to FIGS. 4 and 5, the cited securing means include a knurled wheel 10 which is carried rotatably on a projecting block 11 attached, for example, to the second portion 2 and having at least one section of its external surface arranged to emerge out of the block 11.

The wheel 10 has a shank rotatably accommodated in the block 11, which defines internally a female thread 12, wherein there engages a threaded set screw 14 connected to a strap 15 which is attached with its other end to the first portion 1.

It will be appreciated that the rotation of the wheel 10, acting longitudinally with respect to the strap, will change the working length thereof, that is its length emerging from the block 11, thus enabling the mutual positions of the first and second portions to be varied continuously as desired.

Figure 6:
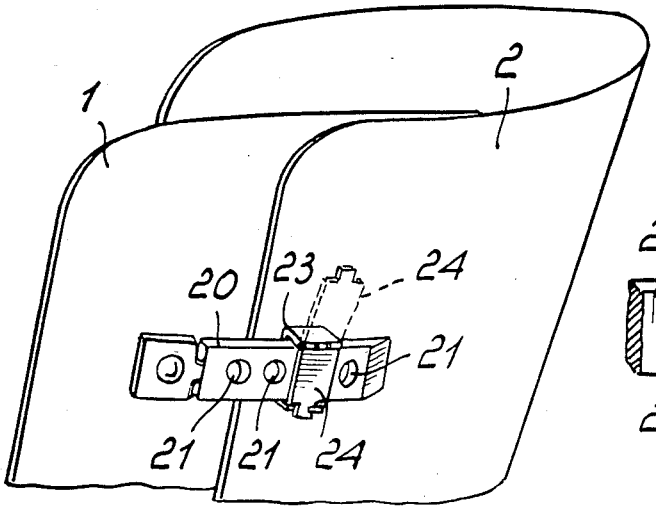
FIG. 6 shows securing means of the strap and fixed pin type.
Figure 7:
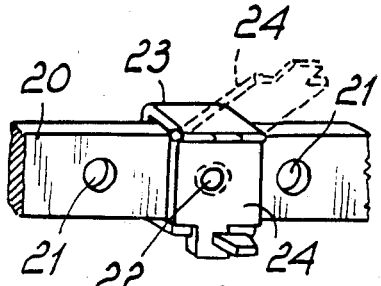
FIG. 7 is a detail view of the strap locking arrangement.

With reference to FIGS. 6 and 7, the securing means comprise a strap 20 formed with throughgoing holes 21, which is attached at one end to the first portion 1 and is engageable in a fixed pin 22 provided on the second portion and accommodated in a housing enclosing the strap 23, the housing having a small door 24 which can be detachably opened to permit a selected hole 21 in the strap 20 to be engaged with the pin 22.

Figure 8:
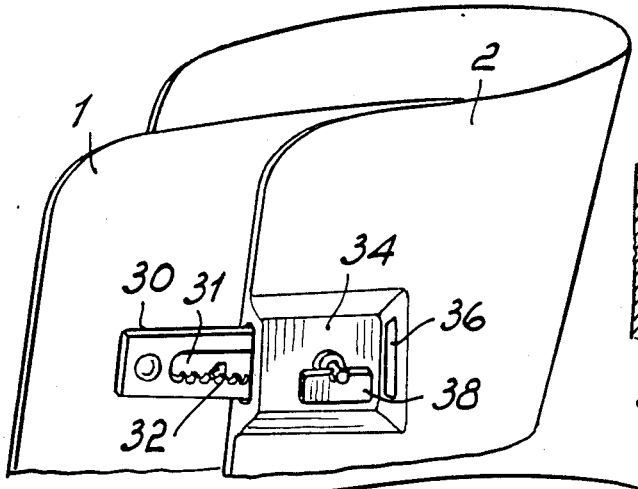
FIG. 8 shows securing means having its strap actuated through a Maltese cross.
Figure 9:
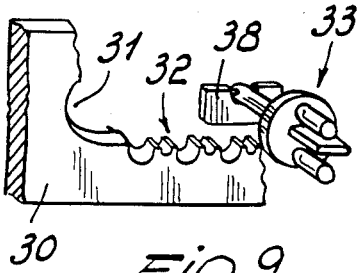
FIG. 9 is a partly cutaway detail view of the Maltese cross.

With reference to FIGS. 8 and 9, the securing means comprise a strap 30 which is attached with one end to the first portion 1 and defines an elongate slot 31, which is formed along its longitudinal edge with a shaped serration 32 in which a Maltese cross device 33 can engage which is rotatably supported on a fixed block 34 provided on the second portion and defines a throughgoing channel 36 wherein the strap 30 can slide.

Also in this embodiment, by turning the knob or tab 38 provided on the actuating stem of the Maltese cross 33, the strap 30 is moved in either direction to change the mutual positions of the first and second portions.

Figure 10:
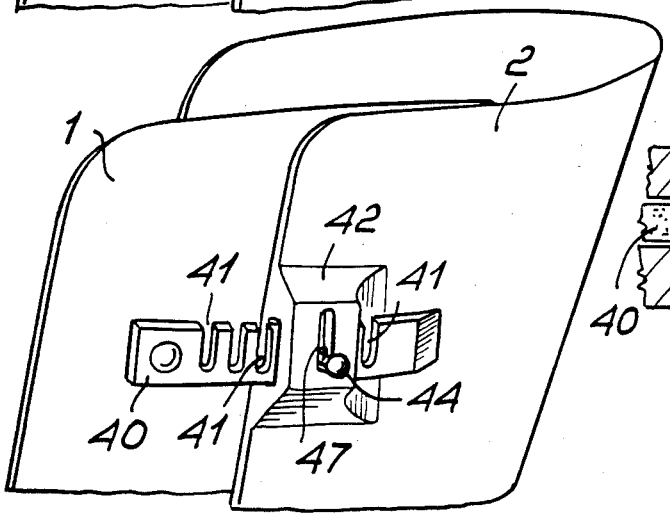
FIG. 10 shows securing means having a movable pin.
Figure 11:
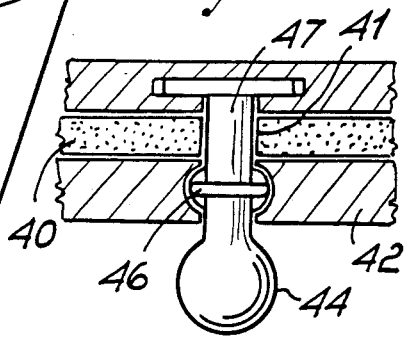
FIG. 11 is a sectional view of the movable pin.

With reference to FIGS. 10 and 11, the securing means includes a strap 40 formed with a plurality of crosswise grooves 41 which open toward one edge of said strap. The strap 40 is slidable inside a fixed block 42 provided on the second portion, wherein is accommodated a pin 44 which is movable transversely to the strap 40 and can be inserted in a selected groove. More specifically, a return spring 46 is provided which acts upon the stem 47 of the pin and holds it within one groove. To change the positioning, it will be sufficient to move the pin 44 up against the elastic action of the spring 46 and shift the strap until the desired position is achieved.

After achieving the desired position, it is sufficient that the pin be released, thereby the spring will force it into a groove and hold it firmly in position.

Figure 12:
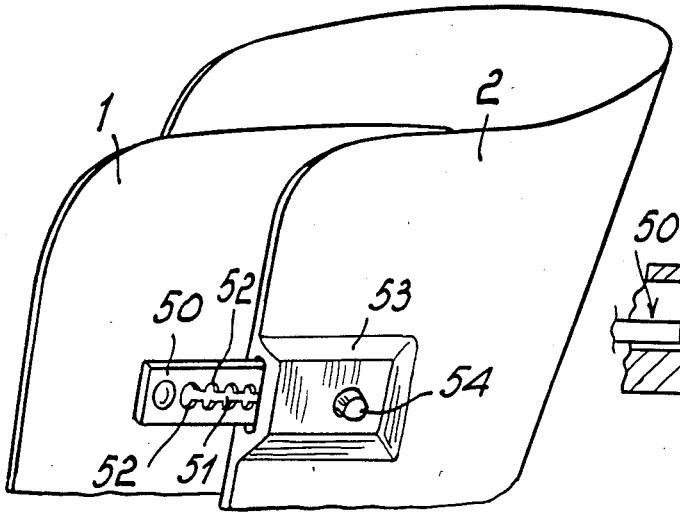
FIG. 12 shows securing means comprising a pushbutton operated strap.
Figure 13:
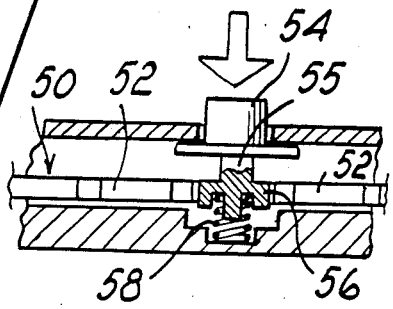
FIG. 13 is a sectional detail view of the pushbutton.

With reference to FIGS. 12 and 13, the securing means comprise a strap 50 having a longitudinal slot 51 formed with widenings 52 at regular intervals. The strap 50 is attached with one end to the first portion 1, while its other end is slidably accommodated in a block 53, where a pushbutton 54 is operative having on its stem 55 an embossment 56. Said pushbutton 54 is linearly movable in a perpendicular direction to the plane containing the strap 50 such that it can be engaged with the slot 51 or stem 55 or embossment 56; where the stem 55 is engaged it is free to slide along the slot 51, whereas if the embossment 56 engages with the strap 50, it is accommodated in the widenings 52 and the strap is inhibited from moving.

The pushbutton is linearly movable against the action of a spring 58 arranged to act on the pushbutton stem.

Figure 14:
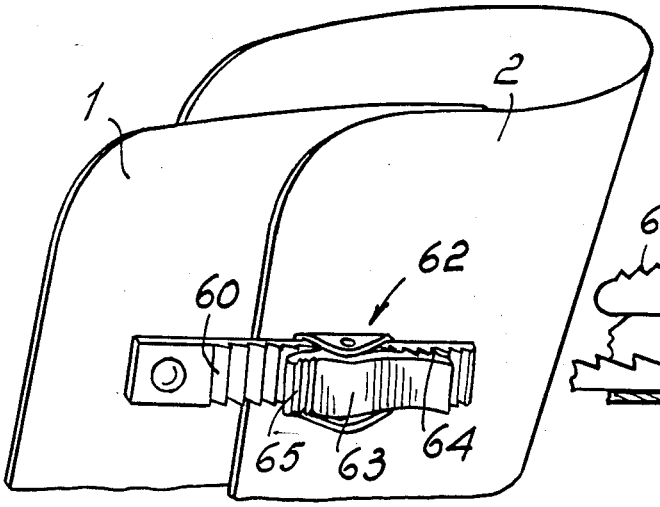
FIG. 14 shows securing means with serrated strap.
Figure 15:
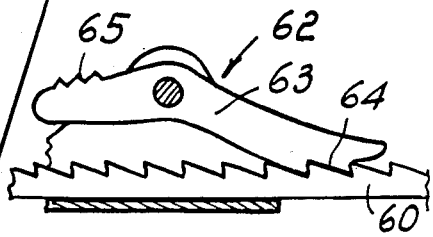
FIG. 15 illustrates how the serrated strap is engaged.

With reference to FIGS. 14 and 15, the securing means comprise a serrated strap 60 which is attached with one end to the first portion 1 and connected to a ratchet gear, generally indicated at 62, and affixed to the second portion. The ratchet gear 62 includes a lever 63, pivoted at its middle portion and having a serrated end 64 which is held engaged with the strap 60 to lock the strap itself whilst, at the other end, it has an actuation lug 65 which, when depressed, overcomes the elastic action of the spring acting on the lever and enables the lever to be disengaged from the strap, thus allowing the latter to slide freely.

Figure 16:
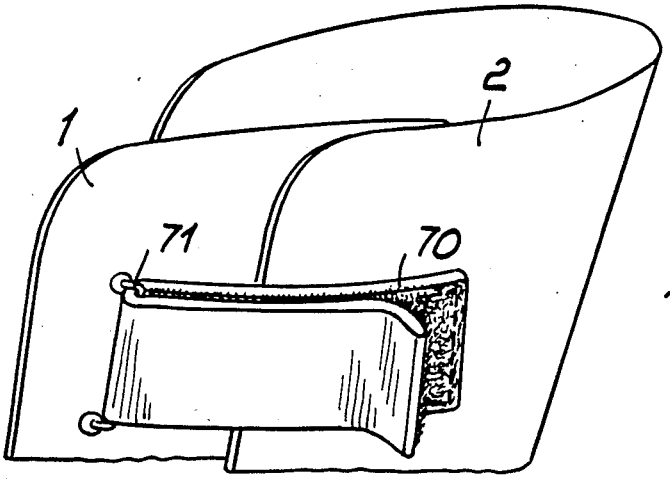
FIG. 16 shows securing means in the form of a pull-out band.

With reference to FIG. 16, the securing means comprise here a pull-out band 70 attached with one end, for example, to the second portion and running in a ring 71 attached to the first portion. The locking is effected, as is customary with pull-out bands, by folding the band over, thus obtaining the desired adhesion force which prevents any relative displacement between the first and second portions.

It will be appreciated from the foregoing description that the invention achieves its objects, and in particular that the provision of a gaiter in two parts which are mutually positionable affords for the user the possibility of adjusting at will and to fit the conformation of the gaiter itself, thus achieving the desired flex and side and forward lean characteristics.

Furthermore, all of the securing means provided have an extremely simple construction and can be operated even in unfavorable conditions, such as are normally encountered on a skiing field.

The invention as described is susceptible to many modifications and variations without departing from the true scope of the instant inventive concept.

Moreover, all of the details are replaceable with other technically equivalent elements.

In practicing the invention, the materials used, as well as the dimensions and contingent shapes, may be any selected ones for the intended applications.

I claim:

1. A composite front gaiter for a shoe, in particular a ski shoe with a flex and side and forward lean adjustment device, said front gaiter having a longitudinal extension, a widthwise extension and an upwards extension and being adapted to be mounted on a shell portion of the ski shoe, said front gaiter including a first gaiter portion having a front side and an open rear side and a second gaiter portion, said first gaiter portion having an overall upwards extension offset to the overall upwards extension of said second gaiter portion, said second gaiter portion overlapping the front side of said first gaiter portion, said first gaiter portion having first hinge means on a lower end thereof with a first hinge axis extending in said widthwise direction, said second gaiter portion having second hinge means on a lower extremity thereof with a second hinge axis extending in said widthwise direction, said second hinge axis being upwardly offset with respect to said first hinge axis thereby to allow independent swinging of said second gaiter portion relative to said first gaiter portion and means for positioning and mutually securing said first and second gaiter portions together.

2. A composite gaiter according to claim 1, wherein said positioning and securing means comprise a strap attached with one end to said first portion and defining an elongate slot formed with step arranged widenings an element attached to said second gaiter portion in the reach of said strap and having a pushbutton movable linearly in a perpendicular direction to the plane containing said strap and provided with a stem adapted to freely slide along said slot and with a widened part adapted to engage in said widenings to lock said strap, said pushbutton having spring means urging said pushbutton in a rest position in which said widened part engages said widenings formed in said slot of the strap.

* * * * *